US008677745B1

(12) United States Patent
Stojanowski

(10) Patent No.: US 8,677,745 B1
(45) Date of Patent: Mar. 25, 2014

(54) ANNULAR STIRLING CYCLE ENGINE

(71) Applicant: John Stojanowski, Staten Island, NY (US)

(72) Inventor: John Stojanowski, Staten Island, NY (US)

( * ) Notice: Subject to any disclaimer, the term of this patent is extended or adjusted under 35 U.S.C. 154(b) by 0 days.

(21) Appl. No.: 13/987,868

(22) Filed: Sep. 11, 2013

(51) Int. Cl.
*F01B 29/10* (2006.01)
*F02G 1/04* (2006.01)

(52) U.S. Cl.
USPC ..... 60/520; 60/525; 60/526

(58) Field of Classification Search
USPC ..... 60/516–526; 418/3
See application file for complete search history.

(56) References Cited

U.S. PATENT DOCUMENTS 4,433,658 A * 2/1984 Stojanowski ..... 123/221

* cited by examiner

*Primary Examiner* — Christopher Jetton

(57) ABSTRACT

A Stirling cycle engine comprised of at least two annular chambers, serving as hot and cold cylinders, which are joined together forming a Figure-8 chamber. A slidable, segmented piston disposed within the Figure-8 chamber, under the influence of thermally induced working fluid pressure changes within the engine, traverses the Figure-8 chamber providing a motive force to generate electric power or transfer mechanical energy external to the engine.

18 Claims, 3 Drawing Sheets

ANNULAR STIRLING CYCLE ENGINE

CROSS-REFERENCE TO RELATED APPLICATIONS

Not Applicable

FEDERALLY SPONSORED RESEARCH

Not Applicable

SEQUENCE LISTING OF THE PROGRAM

Not Applicable

FIELD OF INVENTION

The present invention relates to engines that derive their motive power from external thermal energy sources. These engines are usually broadly categorized as Stirling cycle engines because they rely on the expansion and contraction of a fixed quantity of the gaseous working fluid contained within the engine.

BACKGROUND ART

Invented in 1816 by Scottish clergyman and inventor Robert Stirling, the early Stirling engines were very large machines used in industrial settings as an alternative to steam engines, which had a history of explosive accidents. These engines are sometimes called "hot air engines" although the working fluid used today usually is one of several different gases including air, helium and hydrogen. The use of a regenerator, a component that acts as a temporary thermal storage buffer, positioned between the hot and cold reservoirs of the engine is one of the primary characteristic that distinguishes a Stirling cycle engine from other engines that rely on thermal energy supplied externally. The regenerator contains a matrix material that is able to rapidly absorb and dispense thermal energy.

Interest in Stirling cycle engines has increased in the last few decades. The desire to reduce the use of fossil fuels has been a driving force. Interest in solar energy, geothermal energy and the use of the waste heat produced as a byproduct of various manufacturing processes has directed attention toward developing improved Stirling cycle engines that might be able to utilize various sources of thermal energy.

Deficiencies of Prior Art Stirling Engines

There are several factors which limit the efficiency of prior art Stirling engines:

In those engines that employ a piston/crankshaft design, during the power cycle, the piston rod that transfers energy to the crankshaft delivers maximum energy when it is tangent to the circular crankshaft. At all other times, only a fraction of the energy is used to rotate the crankshaft. Also, whenever either of the two pistons rods are not moving parallel to the axis of their respective cylinders, transverse forces are exerted on the pistons resulting in excessive friction between piston and cylinder.

Any part of the working fluid that does not participate directly in the expansion and contraction cycles will reduce the efficiency of the engine. This dead space, which is also known as unswept volume, can be in several engine structures but is often located in the conduit connecting the hot and cold reservoirs and includes the regenerator. This can be significant depending on the proximity of the two reservoirs. As this volume increases, efficiency decreases.

Stirling cycle engines containing reciprocating pistons generally have low efficiencies. As the working fluid in the hot cylinder is heated and expands, the length of the cylinder and crankshaft linkage will determine the time that the piston within the cylinder can transfer energy to the crankshaft during a cycle. A longer cylinder, in relation to its diameter, increases the energy transfer. The standard design of the power piston's rod/crankshaft linkage found in most prior art Stirling engines limits the ratio of the stroke length/diameter of the piston, and therefore limits the efficiency of the engine.

Most prior art Stirling cycle engines rely on reciprocating piston technology but there are others that have novel non-piston implementations. Among these are a variety of rotary type Stirling engines including patents: U.S. Pat. No. 7,185,492, U.S. Pat. No. 4,753,073, U.S. Pat. No. 5,335,497, U.S. Pat. No. 4,206,604, U.S. Pat. No. 3,984,981, U.S. Pat. No. 6,109,040 and U.S. Pat. No. 8,495,873. All of these, as does the present invention, have a unique design.

In the ideal Stirling engine, all of the working fluid would alternately be heated and then cooled providing completely separate expansion and compression cycles. There would be no concurrent heating and cooling of the working fluid that might cancel out some of the desired expansion/compression effects. Designers of Stirling engines try to minimize the overlap of the heating and cooling of the working fluid but the fixed piston rod/crankshaft linkage constrains this minimization.

The present invention mitigates the above limitations of prior art Stirling engines.

DISCLOSURE OF THE INVENTION

The invention is an external combustion engine which includes at least two annular-shaped cylinders 204 and 208, as shown in FIG. 1, which are of the same dimension and lie in the same plane and intersect forming a continuous Figure-8 space. One annular-shaped cylinder (which can be described as the heat-injection annulus or hot cylinder) is continuously supplied with a source of thermal energy and the alternate cylinder (which can be described as the heat-sink annulus or cold cylinder) is where thermal energy is continuously removed from the engine. A thermal isolation plate 210 helps to reduce thermal short-circuiting between the hot and cold cylinders.

The inter-annulus conduit 213 of FIG. 1 is in fluid communication with the hot cylinder at two ports and the cold cylinder at two ports. One port of the hot cylinder contains a check valve 216 which closes when the working fluid pressure within the hot cylinder reaches a predetermined setting, ensuring that the piston receives the full force of the hot expanding working fluid.

Slidable piston 220 shown in FIG. 1 and FIG. 2A consisting of segments linked together, can traverse the continuous Figure-8 shaped space in a non-reciprocating manner and can alternately transfer the working fluid between the hot cylinder and the cold cylinder. The motive force that drives the piston is the rising working fluid pressure that develops in the hot cylinder and the working fluid pressure difference between the two annular spaces. The segmented piston's length is approximately that of the mean circumference of one of the annular cylinders. The piston can also perform the function of a flywheel although a separate flywheel can be affixed to a drive shaft, as described in one embodiment of the invention.

An end segment 226 of the piston has a spring-loaded protruding diverter element 224 as shown in FIG. 2A which forces the piston to enter the alternate annulus from the one currently being traversed. A spherical or disc-shaped diverter element that is rotatable can be employed.

The working fluid is transferred between the two annular-shaped cylinders within conduits 212, 213 and 214 which provide fluid communication between the two cylinders. A regenerator, containing a heat absorption matrix material, is positioned within conduit 213.

The regenerator is a component which is present in most Stirling engines. Its purpose is to extract thermal energy from the working fluid as it is moved to the cold side of the engine and to transfer thermal energy to the working fluid as it is moved to the hot side of the engine. In doing so, there is a reduction of the irreversible transfer of thermal energy from the hot to cold side and then out of the engine. This recycling of some of the thermal energy increases the efficiency of the engine.

The regenerator improves the efficiency of the engine but its design determines the improvement in efficiency. It must not unduly increase friction to the flow of the working fluid nor should its volume, which is considered dead space that does not participate in expansion and contraction, be too large. There are also limitations on the material that the regenerator can be constructed from if the engine is subject to very high temperatures.

The invention is able to mitigate some of the above disadvantages of the regenerator. The close proximity of the entry and exit points of the inter-annulus conduit 213 of FIG. 1 through which the working fluid passes when it is transferred between the hot and cold side of the engine can result in a very small inter-annulus conduit volume. This can limit the dead space problem. Secondly, the design of the invention with the slidable piston, alternately moving through the hot and the cold cylinder spaces, could incorporate regenerator material imbedded within the segments of the piston, thereby reducing that required in the stationary regenerator or eliminating the stationary regenerator entirely. This implementation could eliminate the fluid friction problem through a stationary regenerator.

Many of the prior art Stirling engines rely on the use of piston rods and crankshafts to transfer energy from the engine. The disadvantages of this method includes excessive piston/cylinder friction, vibration, working fluid leakage and significant crankcase dead space.

In the preferred embodiment of the invention each segment of the piston engages a centrally located gear 236 as shown in FIG. 3, which can provide motive power to external mechanisms. An electrical generator 238 is encapsulated within the engine, eliminating leakage of the working fluid from the engine. The dead space (i.e., unwept volume) associated with piston rod linkages is minimized using the enclosed, direct linkage illustrated.

In engines with conventional piston/piston-rod/crankcase linkages, the ratio of piston-rod length to piston diameter is limited to a relatively small number, usually on the order of one to three. This limits the piston stroke length, and therefore, limits the expansion time during a cycle for the engine to fully convert the expansion energy of the working fluid to motive power. The present invention effectively has a piston-stroke length/piston diameter ratio that can be many times higher than that of the power piston used in prior art Stirling engines, thereby improving efficiency.

The drawing of the invention uses annular-shaped hot and cold chambers whose cross-section is square, the same is true of the segmented piston. It is understood that the cross-sectional shape of these components can be drawn from a wide selection of shapes. For example, an elliptical shape (of which a circle would be a specific instance) could be employed.

The source of thermal energy delivered to the hot side of the engine can come from many different sources, which would require variation in the design of the thermal energy delivery interface. For example, solar energy could be delivered directly to the hot cylinder using a parabolic solar dish, mirrors, a Fresnel lens, or by indirectly heating a fluid using a solar power trough. The thermal energy could be supplied from geothermal sources, waste heat from internal combustion engines, manufacturing processes, agricultural waste products, heat pumps, bodies of water or any other heat source. FIGS. 1-4 illustrate only two of several methods of supplying and removing thermal energy from the engine. It is understood that there are many other conductive, convective and radiant configurations that could be employed.

The working fluid used can be any gaseous fluid that will not undergo a change of state within the engine. Air, helium, hydrogen, nitrogen and chlorinated fluorocarbons are a few examples of working fluids currently utilized. As with prior art Stirling engines, the power output of the engine can be increased by raising the pressure of the working fluid. The addition of a Schrader valve port (not shown in drawings) allowing modification of the internal pressure of the engine can be provided.

The above specification applies to the preferred embodiment of the invention.

The second embodiment of the invention is shown in FIG. 5 and contains the same specification as the preferred embodiment with differences that will be described in the Detailed Discussion. The engine in this embodiment does not deliver direct mechanical energy external to the engine. It generates electrical energy by imbedding magnetic material within the slidable piston, which is able to induce an electric current in a helically wound coil surrounding the piston.

The invention cannot be accurately classified as an alpha, beta or gamma type of Stirling engine. The alpha model is characterized by the presence of two distinct chambers (i.e., cylinders), one hot and one cold, each containing a piston that reciprocates in their respective cylinder. The beta and gamma models utilize a displacer piston in addition to a power piston. The displacer piston transfers the working fluid between the hot and cold chambers. The present invention utilizes a single, segmented piston that serves as both a power piston and a displacer piston, traversing both the hot and cold chambers.

While the invention is subject to various modifications and alternative forms, specific embodiments thereof have been shown by way of example in the drawings and will herein be described in detail. The invention should be understood to not be limited to the particular forms disclosed, but on the contrary, the intention is to cover all modifications, equivalents, and alternatives falling within the spirit and scope of the invention.

BRIEF DESCRIPTION OF THE DRAWINGS

An example of the engine will now be described with reference to the following drawings.

DETAILED DISCUSSION or BEST MODE FOR CARRYING OUT THE INVENTION

In the following description, numerous specific details are set forth, such as named components, connections, types of practical applications using the design, etc., in order to provide a thorough understanding of the present invention. It will be apparent, however, to one skilled in the art that the present invention may be practiced without these specific details. In other instances, well known components or methods have not been described in detail in order to avoid unnecessarily obscuring the present invention. Thus, the specific details set forth are merely exemplary. The specific details may be varied from and still be contemplated to be within the spirit and scope of the present invention.

Figure 1:
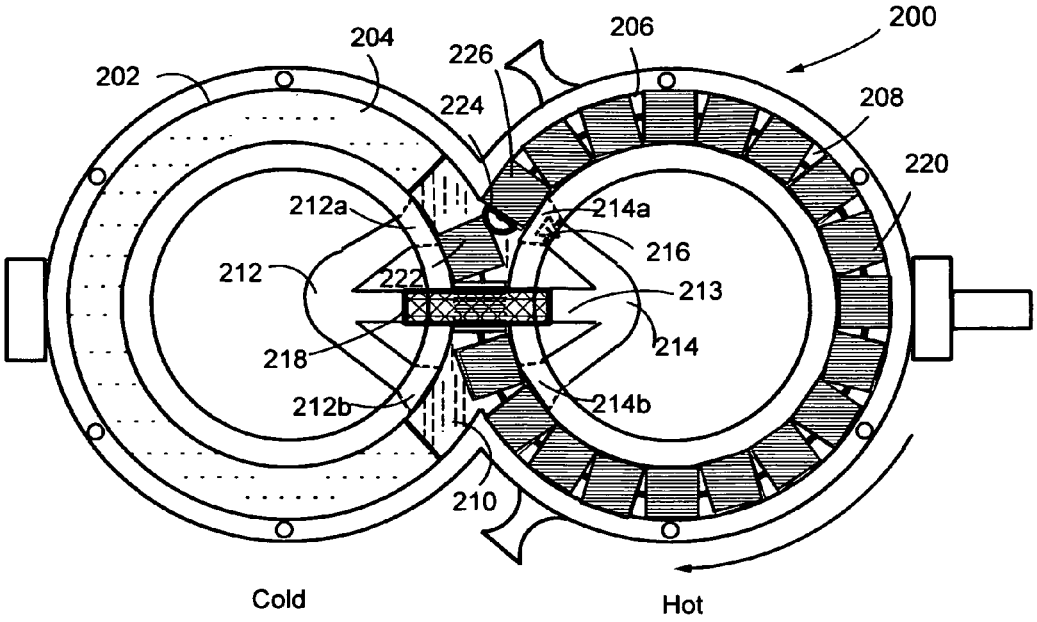
FIG. 1 is a longitudinal segmented view of the engine without the top plate enclosure.
Figure 3:
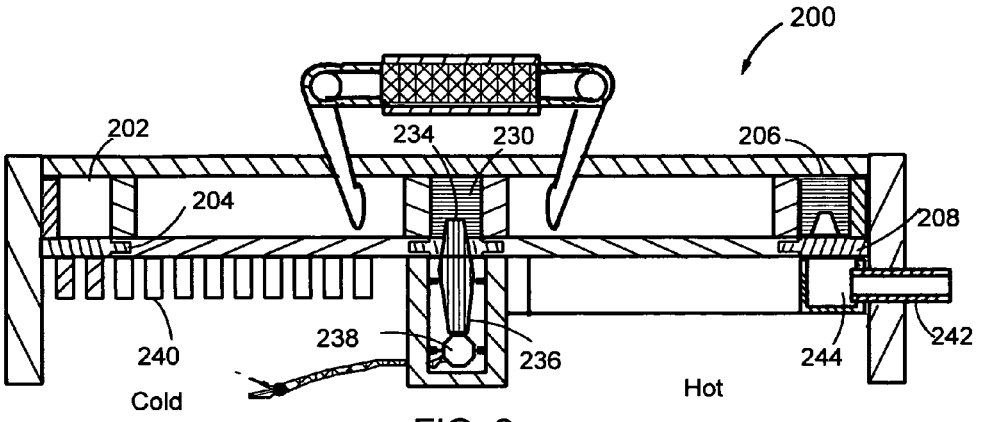
FIG. 3 is a longitudinal sectional view of the engine with the segmented piston disposed within the heat injection annulus (i.e., the hot cylinder).

FIG. 1 is a view of the engine 200 with the top cover plate removed Annular chamber 202, which is on the left side, is the heat sink annulus, or cold cylinder. Annular bottom plate 204 of this heat sink annulus is composed of a material of high thermal conductivity. Thermal energy is removed from the engine through this plate. Radiator fins 240, as shown in FIG. 3 are attached to this plate to remove thermal energy, however other methods such as a fluid cooling coil may be employed.

Annular chamber 206, which is on the right side, is the heat injection annulus, or hot cylinder. Bottom plate 208 of this heat injection annulus is composed of a material of high thermal conductivity. Thermal energy is injected into the engine through this plate. Annular conduit 244 as shown in FIG. 3, capable of guiding a heated thermal fluid to the bottom surface of the heat injection annulus, is employed. This is one of several methods of heat injection which may be implemented. Radiative thermal energy delivery to bottom plate 208 of hot cylinder 206 by solar energy concentration devices may be employed as well.

Engine bottom plates 208 of the hot cylinder and 204 of the cold cylinder are thermally isolated from each other by the thermal isolation plate 210, which is composed of a heat resistant material of low thermal conductivity.

Conduits 212, 213 and 214 provide a means for transferring the working fluid of the engine from one annular chamber to the alternate annular chamber. Conduit 212 is in fluid communication with the cold cylinder at ports 212*a* and 212*b*. Conduit 214 is in fluid communication with the hot cylinder at ports 214*a* and 214*b*. Check valve 216 at port 214*a* prevents the heated working fluid from moving from hot cylinder 206 to cold cylinder 202 during the expansion (i.e., power) cycle.

Regenerator 218 is centrally disposed within inter-annulus conduit 213. All inter-annulus transfers of working fluid take place through the regenerator. The regenerator contains a porous matrix material capable of rapidly absorbing thermal energy from the heated working fluid and rapidly dispensing that energy to a cooled working fluid. The engine will function without a regenerator but will do so at a lower efficiency. The design of the engine, with the piston traversing both hot and cold cylinders, would also permit the regenerator function to be built into the slidable piston.

Slidable segmented piston 220 of FIG. 1 is disposed within hot cylinder 206. Leading piston segment 222, as shown, is beginning to alter the segmented piston's path from hot cylinder 206 to cold cylinder 202. It is guided in this transition to the alternate annulus by retractable diverter means 224 within the trailing surface of terminal piston segment 226. Retractable diverter means 224 can be rotatably enabled to minimize frictional loses; it can be disc-shaped or spherically-shaped.

As slidable piston 220 enters the cold cylinder 202, the working fluid in that chamber has been cooled and is near its lowest temperature and pressure. Port 212*a* is then sealed by the piston, port 212*b* and port 214*a* are unsealed allowing the sliding piston to transfer the working fluid in cold cylinder 202 through port 212*b*, regenerator 218 and into hot chamber 206 through unsealed port 214*a*.

Check valve 216 in port 214*a* opens when the increasing working fluid pressure in the cold cylinder exceeds the pressure in the hot cylinder by a predetermined value. The working fluid will continue to be transferred to the hot cylinder where its pressure and temperature will rapidly increase until the working fluid pressure in the hot cylinder rises above that of the cold cylinder by a predetermined value closing check valve 216. The full expansive force of the heated working fluid in the hot cylinder will then drive the piston from the hot cylinder into the cold cylinder until check valve 216 opens as the fluid pressure in the hot cylinder decreases until it is below a predetermined value. Nearly all of the working fluid is now in the hot cylinder and is near its highest temperature while its pressure has been lowered during the expansion. During the next part of the cycle the piston's motion is powered by the momentum of the piston and, depending on the engine's configuration, a separate flywheel.

Slidable piston 220 will then have fully transitioned from the hot cylinder to the cold cylinder. It then enters the hot cylinder unsealing port 212*a* and sealing port 214*a* permitting the working fluid to transfer from the hot cylinder through port 214*b*, regenerator 218 and into the cold cylinder through port 212*a*. As the working fluid enters the cold cylinder its temperature is lowered during contact with bottom plate 204. The piston will then continue to sweep the heated working fluid into the cold cylinder as it transitions from the cold cylinder to the hot cylinder until it fully occupies the hot cylinder.

The slidable piston is now in the original position and the cycle repeats.

Figure 2A:
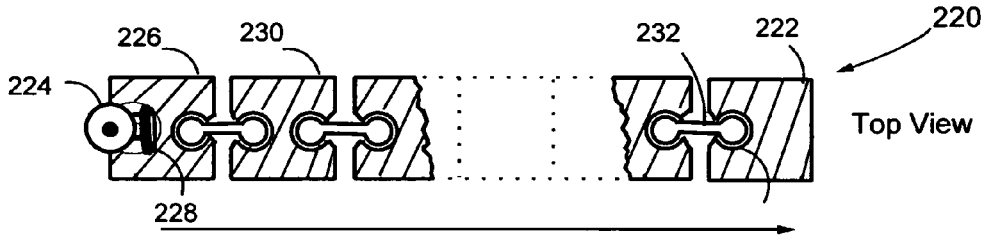
FIG. 2A is a longitudinal sectional view of the segmented piston (top view).

FIG. 2A is a longitudinal sectional top view of segmented piston 220. Leading piston segment 222 is shown. Terminal piston segment 226 contains rotatable, retractable diverter means 224 with spring tension means 228. Inter-segment linkage means 232 is shown.

Figure 2B:
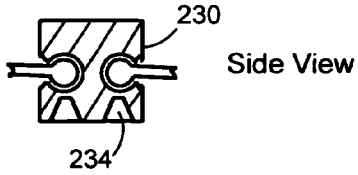
FIG. 2B is a sectional view of a single segment of the segmented piston (side view).

FIG. 2B is a side sectional view of an interior piston segment 230. Gear tooth engagement means 234, which is present in all piston segments, transfers kinetic energy to a central gear/flywheel means 236 (shown in FIGS. 3-4).

FIG. 3 is a longitudinal sectional view of the engine with the segmented piston disposed within the hot cylinder 206. Engagement of piston segment gear tooth means 234 of an interior piston segment 230 with centrally disposed gear/flywheel means 236 is shown.

In the preferred embodiment of the invention, the central gear/flywheel means 236 powers an encapsulated electric generator 238. This sealed configuration minimizes the possibility of working fluid leakage from the engine. The extension of the shaft of the central gear/flywheel means 236 through the engine housing (not shown) may be used to deliver mechanical energy external to the engine.

Thermal energy is removed from the cold cylinder 202 using an array of fin elements 240, which are below and in contact with the bottom plate 204 of the cold cylinder. Those skilled in the art understand that there are many methods of removing thermal energy from a Stirling-type engine in addition to that shown in the preferred embodiment. The use of a forced circulation of low temperature fluids, liquid or gaseous, and the use of refrigerant-based heat pipes and heat pumps can be implemented.

Figure 4:
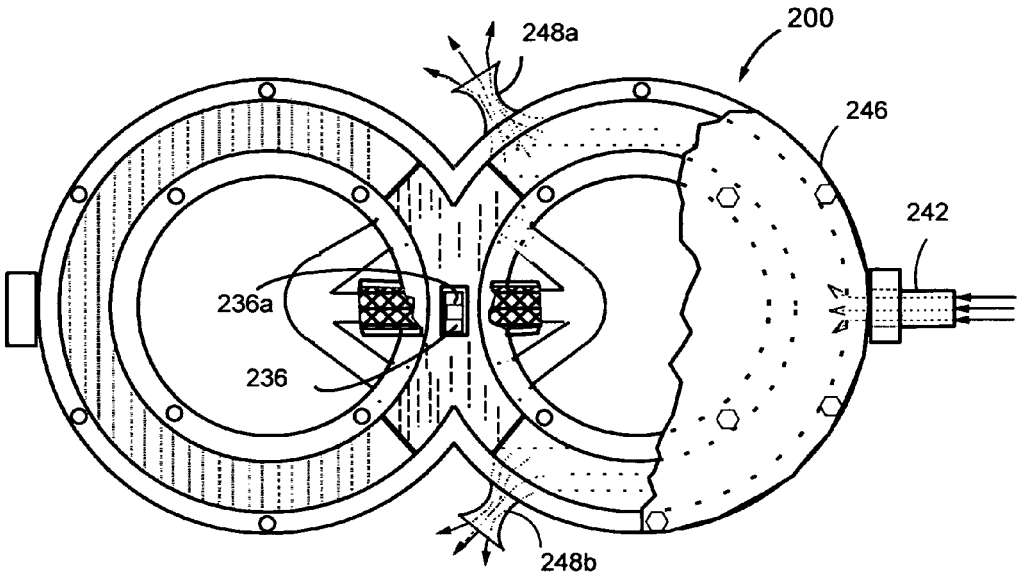
FIG. 4 is a longitudinal, segmented broken view of the engine without the slidable, segmented piston.

Similarly, thermal energy can be injected into the engine in a variety of ways. In the preferred embodiment, heated fluid (either liquid or gaseous) enters heat injection port 242 (as shown in FIGS. 3-4) where it flows within annular chamber 244 and transfers thermal energy to bottom plate 208 of hot cylinder 206. Alternate methods of delivery of thermal energy may be used including heat pipes, refrigerant based transfers, geothermal and direct and indirect solar energy injection.

FIG. 4 is a top view of the engine 200 with the segmented piston removed and top plate cover 246 partially cut away. Gear tooth means 236*a* of central gear/flywheel 236 is centrally disposed. Each segmented piston engages and transfers power to the central gear/flywheel 236 at this point. In the preferred embodiment, thermal energy is delivered to the engine by forced flow of a fluid through heat injection port 242. The thermally depleted fluid exits the engine at exit ports 248*a* and 248*b*.

Figure 5:
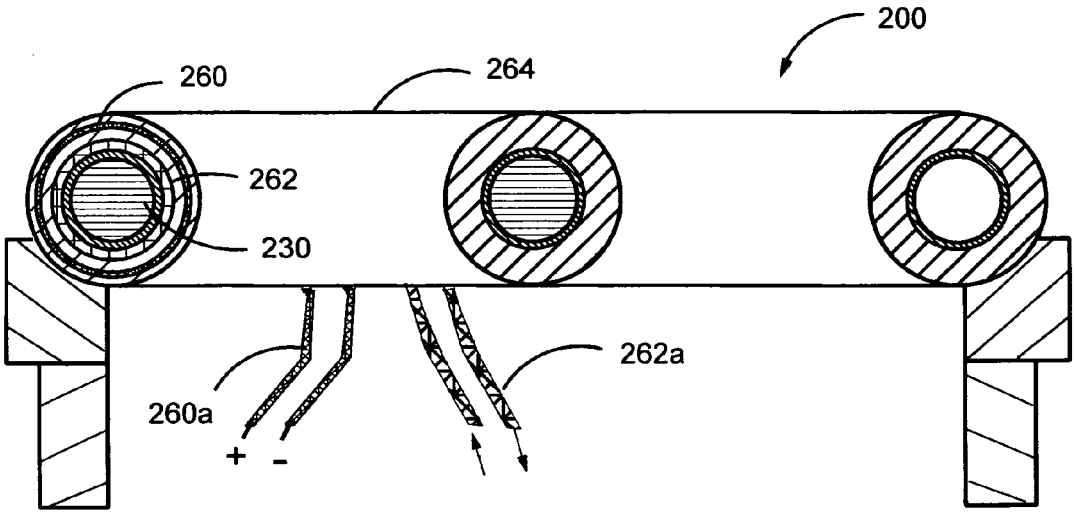
FIG. 5 is a schematic representation the second embodiment of the engine in which a cross-sectional view of the cold annulus illustrates the coaxial cooling coil and the coaxial electrical induction coil imbedded within the cold annulus wall. The inter-annulus conduits and regenerator have not been drawn to simplify the basic concept of this embodiment, however they are identical to that of the preferred embodiment.

FIG. 5 illustrates the second embodiment of the invention. The construction of this embodiment is the same as that of the preferred embodiment except for the following:

a) The central gear which transmits kinetic energy from the slidable piston is not present, eliminating any mechanical linkage external to the engine.

b) The piston segments do not contain a gear-engaging means.

c) The piston segments contain magnetic material aligned in a way that permit them, when in motion, to induce an electrical current in an electrical circuit surrounding the piston.

d) The cross-sectional shape of the hot and cold cylinders and the cross-sectional of the piston segments are circular but they do not have to be, i.e., the hot and cold cylinders are toroidal.

e) The electrical circuit is a helically wound coil 260 as shown in FIG. 5 which is imbedded within the walls of at least one of the two annuluses.

f) Helically wound heating or cooling coil 262, imbedded within the toroidal walls enclosing the hot and cold cylinders is used to inject thermal energy or to remove it.

The mode of operation of the slidable piston in this second embodiment is the same as that of the preferred embodiment. As the piston 230 moves through each cylinder that contains helically wound induction coil 260, an electric current will be induced within the coil. The induction coil's terminal point 260*a* extends beyond the engine's exterior surface to provide electrical power.

The hot cylinder, in one aspect of the second embodiment of the invention, can have thermal energy injected into it by having a solar energy concentration means directing solar energy on the hot cylinder's exterior toroidal surface.

The helically wound induction coil is shown imbedded within the toroidal wall of one of the annuluses but may be wound around the exterior surface 264 depending primarily upon the method used to inject and remove thermal energy. Similarly, either one or both annuluses may have a helically wound heating or cooling coil 262 depending on various factors including, but not limited to, thermal injection and removal method employed, heat sink/heat source temperature differential, etc. The helically wound heating/cooling coil's terminal point 262*a* extends beyond the engine's exterior surface 264.

The cross-sectional shape of the piston and annuluses are not limited to a circle; many other configurations can also be implemented.

Figure 6:
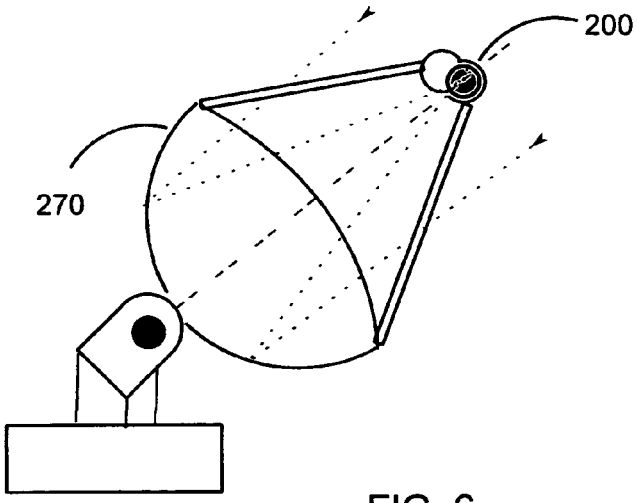
FIG. 6 is an elevational view of the engine powered by a parabolic solar dish.

FIG. 6 illustrates the engine of the second embodiment where the heat source is a parabolic dish 270 concentrating solar energy on the surface of the engine 200 directly onto the hot cylinder. Alternate methods of injecting solar energy are possible for both embodiments of the invention. For example, a solar energy trough may be used to supply either embodiment of the invention with a heated thermal fluid.

I claim:

1. A Stirling cycle engine comprising:

at least one pair of annular chambers of the same internal dimensions joined together forming a sealed continuous Figure-8 shaped chamber;

the Figure-8 shaped chamber is filled with a gaseous working fluid;

one of the paired annular chambers is supplied with thermal energy and functions as a hot cylinder and the other annular chamber has thermal energy removed and functions as a cold cylinder;

a slidable piston comprised of multiple segments linked together disposed within the contiguous Figure-8 chamber and in constant slidable contact against the Figure-8 chamber;

the slidable piston traverses the Figure-8 shaped chamber when thermal energy is injected into the hot cylinder and removed from the cold cylinder;

the slidable piston, when in motion, moves the working fluid alternately between the hot cylinder and the cold cylinder;

the slidable piston's segment's cross-sectional shape and cross-sectional area are the same as that of the Figure-8 shaped chamber; and at least one inter-annulus passage between the hot cylinder and the cold cylinder, wherein the working fluid traverses the inter-annulus passage in both directions.

2. The engine of claim 1 wherein an end segment of the slidable piston contains a protruding, retractable element capable of diverting the path of the slidable piston from one of the annular chambers to the other annular chamber.

3. The engine of claim 2 further comprising a regenerative heat exchanger in communication with the hot and cold cylinders transferring residual thermal energy between the hot and cold cylinders enabling the engine to utilize the maximum amount of heat available.

4. The engine of claim 3 wherein the inter-annulus passage is in fluid communication with the hot cylinder at two ports and in fluid communication with the cold cylinder at two ports.

5. The engine of claim 4 further comprising a check valve disposed within at least one of the ports, the check valve can be set to stop the flow of the working fluid between the hot and cold cylinders based on a predetermined pressure differential.

6. The engine of claim 5 further comprising a thermal insulating element between the hot cylinder and the cold cylinder limiting thermal short-circuiting between the hot and cold cylinders.

7. The engine of claim 6 further comprising at least one drive shaft gearably driven by the slidable piston segments.

8. The engine of claim 7 further comprising an electrical generator integrated with the drive shaft.

9. The engine of claim 8 wherein the source of the thermal energy delivered to the hot cylinder is from a solar energy concentration device.

10. The engine of claim 7 wherein the slidable piston's kinetic energy is converted to mechanical energy for use external to the engine.

11. A Stirling cycle engine comprising:

at least one pair of annular chambers of the same internal dimensions joined together forming a sealed continuous Figure-8 shaped chamber;

the Figure-8 shaped chamber is filled with a gaseous working fluid;

one of the paired annular chambers is supplied with thermal energy and functions as a hot cylinder and the other annular chamber has thermal energy removed and functions as a cold cylinder;

a slidable piston comprised of multiple segments linked together disposed within the contiguous Figure-8 chamber and in constant slidable contact against the contiguous Figure-8 chamber;

the slidable piston traverses the contiguous Figure-8 shaped chamber when thermal energy is injected into the hot cylinder and removed from the cold cylinder;

the slidable piston, when in motion, moves the working fluid alternately between the hot cylinder and the cold cylinder;

the slidable piston's segment's cross-sectional shape and cross-sectional area are the same as that of the Figure-8 shaped chamber; and at least one inter-annulus passage between the hot cylinder and the cold cylinder, wherein the working fluid traverses the inter-annulus passage in both directions.

12. The engine of claim 11 wherein an end segment of the slidable piston contains a protruding, retractable element capable of diverting the path of the slidable piston from one of the annular chambers to the other annular chamber.

13. The engine of claim 12 further comprising a regenerative heat exchanger in communication with the hot and cold cylinders transferring residual thermal energy between the hot and cold cylinders enabling the engine to utilize the maximum amount of heat available.

14. The engine of claim 3 wherein the inter-annulus passage is in fluid communication with the hot cylinder at two ports and in fluid communication with the cold cylinder at two ports.

15. The engine of claim 14 further comprising a check valve disposed within at least one of the ports, the check valve can be set to stop the flow of the working fluid between the hot and cold cylinders based on a predetermined pressure differential.

16. The engine of claim 15 further comprising a thermal insulating element between the hot cylinder and the cold cylinder limiting thermal short-circuiting between the hot and cold cylinders.

17. The engine of claim 16 further comprising magnetic material imbedded within the slidable piston segments capable of inducing an electric current in an electric coil circumscribing at least one of the paired annular chambers when the piston is in motion.

18. The engine of claim 17 wherein the source of the thermal energy delivered to the hot cylinder is from a solar energy concentration device.

* * * * *